US008668861B1

(12) United States Patent
Steen

(10) Patent No.: US 8,668,861 B1
(45) Date of Patent: Mar. 11, 2014

(54) PROTECTIVE EDGING FOR A CATHODE OF AN ELECTROPLATING SYSTEM

(71) Applicant: Steen Enterprises, LLC, Amarillo, TX (US)

(72) Inventor: Richard W. Steen, Amarillo, TX (US)

(73) Assignee: Steen Enterprises, LLC, Amarillo, TX (US)

( * ) Notice: Subject to any disclaimer, the term of this patent is extended or adjusted under 35 U.S.C. 154(b) by 0 days.

(21) Appl. No.: 13/769,596

(22) Filed: Feb. 18, 2013

Related U.S. Application Data

(62) Division of application No. 13/272,957, filed on Oct. 13, 2011, now Pat. No. 8,404,167, which is a division of application No. 12/358,786, filed on Jan. 23, 2009, now Pat. No. 8,052,851.

(51) Int. Cl.
*B29C 45/58* (2006.01)

(52) U.S. Cl.
USPC ..... 264/328.6; 366/91; 425/205

(58) Field of Classification Search
USPC ..... 264/328.6, 272.11; 366/91, 336–339; 425/205
See application file for complete search history.

(56) References Cited

U.S. PATENT DOCUMENTS

| | | | | |
|---|---|---|---|---|
| 2,658,237 | A | 11/1953 | Cuppett et al. | |
| 3,178,769 | A * | 4/1965 | Lorenian | 425/207 |
| 3,874,643 | A * | 4/1975 | Lorenian et al. | 366/76.92 |
| 3,924,989 | A * | 12/1975 | Althausen et al. | 425/130 |
| 4,207,147 | A | 6/1980 | Babin | |
| 4,305,672 | A * | 12/1981 | Adams | 366/336 |
| 4,479,854 | A | 10/1984 | Willans et al. | |
| 4,594,005 | A * | 6/1986 | Sakamoto et al. | 366/181.5 |
| 5,182,061 | A | 1/1993 | Yasuda et al. | |
| 5,314,600 | A | 5/1994 | Webb et al. | |
| 5,397,179 | A * | 3/1995 | Berlin et al. | 366/337 |
| 5,785,827 | A | 7/1998 | Dougherty | |
| 5,928,482 | A | 7/1999 | Marttila | |
| 6,017,429 | A | 1/2000 | Persson | |
| 6,495,084 | B1 | 12/2002 | Held, III et al. | |
| 6,652,960 | B1 | 11/2003 | Watanabe et al. | |
| 6,746,581 | B2 | 6/2004 | Ebert | |
| 7,799,257 | B2 | 9/2010 | Jamia | |
| 7,988,903 | B2 * | 8/2011 | Manley et al. | 264/328.6 |
| 2006/0051448 | A1 * | 3/2006 | Schryver et al. | 425/381 |
| 2006/0063850 | A1 | 3/2006 | Kanae et al. | |
| 2008/0095655 | A1 | 4/2008 | Webb | |

* cited by examiner

*Primary Examiner* — Jill Heitbrink

(74) *Attorney, Agent, or Firm* — Mark E. Scott; Conley Rose, P.C.

(57) ABSTRACT

Protective edging for a cathode of an electroplating system. At least some of the illustrative embodiments a cathodes of an electroplating system, the cathodes including a sheet of metallic material that defines a front, a back and an edge, a plurality of apertures through the metallic material proximate to a portion of the edge and a plastic material that envelops the portion of the edge and the plurality of apertures. The plastic material extends through the apertures and is adhered to the metallic material.

20 Claims, 8 Drawing Sheets

PROTECTIVE EDGING FOR A CATHODE OF AN ELECTROPLATING SYSTEM

CROSS-REFERENCE TO RELATED APPLICATIONS

This application claims priority to, and is a divisional of, U.S. application Ser. No. 13/272,957 filed Oct. 13, 2011, titled "Protective Edging for a Cathode of an Electroplating System," which claimed priory to U.S. application Ser. No. 12/358,786, filed Jan. 23, 2009 (now issued U.S. Pat. No. 8,052,851) both of which are incorporated by reference herein as if reproduced fully below.

BACKGROUND

One of the final steps in the refining of copper is an electroplating step, where the copper is electroplated onto metallic plates. In particular, copper anodes (of about 99% pure copper) are placed within a sulfuric acid solution, and an electrical charge is induced between the anodes and a plurality of metallic plates acting as cathodes. The copper from the anodes electroplates onto exposed metallic surface of the cathodes, with the electroplated copper being about 99.9% pure.

If no portion of the cathode suspended within the sulfuric acid solution is protected from the sulfuric acid solution, then the copper electroplated completely encases the portion of the cathode suspended within the sulfuric acid solution. However, having the copper completely encase the cathode makes removal of the copper difficult. In order to ease removing the electroplated copper from the cathode, the edge of the cathode is protected from contact with sulfuric acid solution, and thus the copper does not electroplate onto the protected edge.

In the related art, the edge of the cathode is protected by tape adhered to the edge of the cathode, along with a plastic clip with a "C" shape cross-section placed over the tape. Coupling of the plastic clip is merely by clamping force exerted by outward displacement of the "C" shape structure. The thickness of the cathodes may vary with age of the cathode, and thus the clamping force exerted by the "C" shape is inconsistent. In other cases, non-metallic fasteners may couple to the "C" shaped plastic clip through the underlying cathode to assist in keeping the plastic clip attached. Thus, regardless of the precise mechanism utilized to attach the plastic clip, the plastic clip does not adhere to the underlying cathode.

However, the cathodes are subject to bending and flexing during handling. Further, the cathodes are also subject to being struck by, and striking, other cathodes and anodes during placement into and removal from the sulfuric acid solution tanks. The flexing and striking tends to damage the "C" shaped plastic clips and/or the tape. In some cases, the tape and "C" shaped plastic clips may last as few as three days before needing replacement, and rarely will the "C" shaped plastic clips and tape last more than three months. Damaged cathodes may produce irregularly shaped copper pieces, or copper pieces that are difficult to remove from the cathodes.

Thus, any advance in protecting the edges of the metallic cathodes would reduce cost of the electroplating process, and provide a competitive advantage.

BRIEF DESCRIPTION OF THE DRAWINGS

For a detailed description of exemplary embodiments, reference will now be made to the accompanying drawings in which.

NOTATION AND NOMENCLATURE

Certain terms are used throughout the following description and claims to refer to particular system components. As one skilled in the art will appreciate, refining companies may refer to a component by different names. This document does not intend to distinguish between components that differ in name but not function.

In the following discussion and in the claims, the terms "including" and "comprising" are used in an open-ended fashion, and thus should be interpreted to mean "including, but not limited to . . . " Also, the term "couple" or "couples" is intended to mean either an indirect or direct connection. Thus, if a first device couples to a second device, that connection may be through a direct connection or through an indirect connection via other devices and connections.

"Adhere" and "adhered" shall mean a substantially watertight bond of two materials. The bonding of the surfaces may be by chemical forces between the materials at the interface, by interaction of the materials at the interface (e.g., material of a first surface fills voids or pores of the material of the second surface, thus holding the surfaces together by interlocking), or both. Two materials held together by mechanical forces (e.g., force supplied by a fastener, or force created by displacement of a resilient material from its rest orientation), shall not be considered adhered for purposes of this disclosure and claims.

"About" shall mean that the thickness, distance or width which the "about" modifies shall still be considered present if the thickness, distance or width is within manufacturing tolerances.

DETAILED DESCRIPTION

The following discussion is directed to various embodiments of the invention. Although one or more of these embodiments may be preferred, the embodiments disclosed should not be interpreted, or otherwise used, as limiting the scope of the disclosure, including the claims. In addition, one skilled in the art will understand that the following description has broad application, and the discussion of any embodiment is meant only to be exemplary of that embodiment, and not intended to intimate that the scope of the disclosure, including the claims, is limited to that embodiment.

The various embodiments were developed in the context of metallic sheets or plates used as cathodes in the process of refining copper, and the application is based on the developmental context. However, the various embodiments may be applicable to electroplating of other metals, and thus the developmental context should not be construed as a limitation as to the applicability of the various embodiments.

Figure 1:
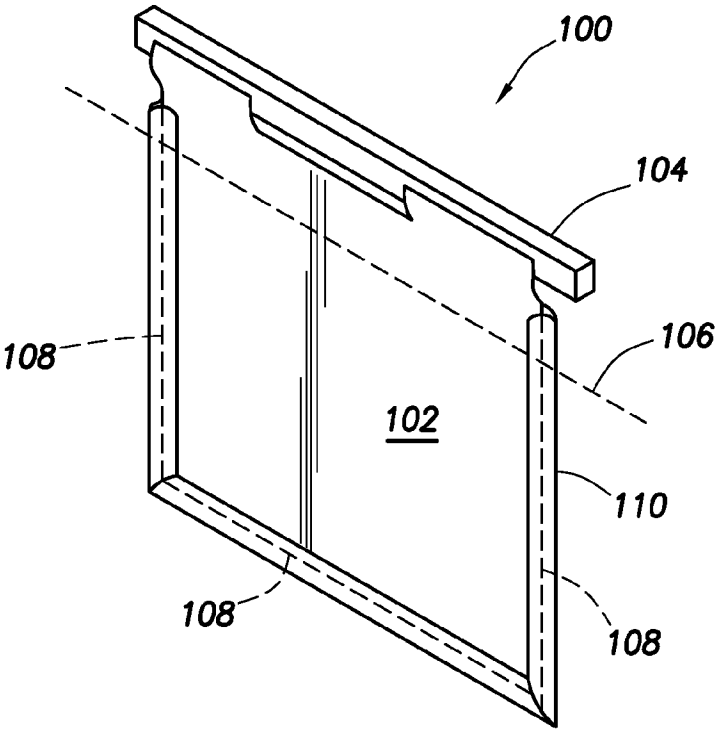
FIG. 1 shows a perspective view of a cathode in accordance with at least some embodiments.

FIG. 1 shows a perspective view of cathode 100 of an electroplating system in accordance with at least some embodiments. In particular, the cathode 100 comprises a plate or sheet of metallic material 102, upon which the copper from an anode (not shown) is electroplated. The metallic material 102 is illustrated as a rectangle, but other shapes, such as other quadrilateral shapes (e.g., square), may be equivalently used. In some embodiments, the metallic material 102 is titanium, but other materials may be equivalently used. The metallic material 102 mechanically and electrically couples to a hanger member 104. The hanger member 104 is configured to suspend the cathode 100 within a solution (e.g., sulfuric acid solution) during the electroplating, and may also be the location where electrical leads are coupled to the cathode 100 for purposes of inducing the electrical potential between the cathode 100 and the anode. In some embodiments the hanger member 104 is copper, but other metallic materials may be equivalently used.

In the particular, non-limiting example of electroplating copper, the cathode 100 is suspended at least partially in a vat containing a sulfuric acid solution, in some cases about a 10% sulfuric acid solution at approximately 170 degrees Fahrenheit. The upper surface of the sulfuric acid solution may reside, for example, substantially along the dashed line 106. At and below the surface of the sulfuric acid solution, copper is electroplated to any metallic surface that is accessible by the sulfuric acid solution and which has the induced electric potential. In order to easily remove the electroplated copper from each side of the metallic material 102 (only one side is visible in FIG. 1), the outer edge 108 (shown in dashed lines) of the metallic material 102 is enveloped by a plastic material 110. As is discussed in greater detail below, the plastic material 110 adheres to the metallic material 102. The plastic material 110 reduces or eliminates the electroplating on the portion of the metallic material 102 enveloped by the plastic material 110. While FIG. 1 shows that the three edges 108 below the solution level 106 have the plastic material 110, in other embodiments only two edges (e.g., the vertical edges) have the plastic material, and thus the metal electroplated to the metallic material 102 may extend around an edge, and thus be removed as one piece.

Figure 2:
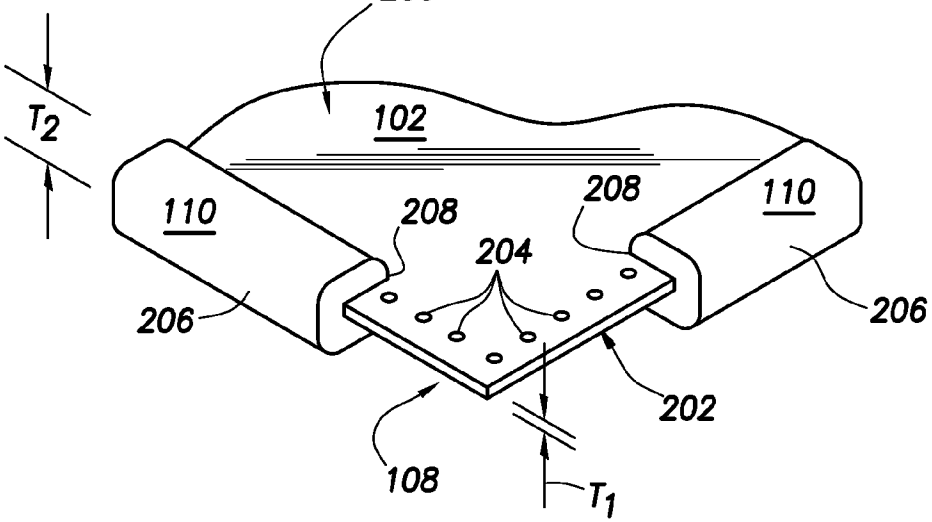
FIG. 2 shows a perspective, partial cut-away, view of a corner of a cathode in accordance with at least some embodiments.

FIG. 2 shows a perspective view of a portion of the metallic material 102 with a portion of the plastic material 110 removed to reveal the underlying structure. In particular, FIG. 2 illustrates the metallic material 102 defines a front 200, a back 202 (not visible) and the edge 108. The metallic material 102 further comprises a plurality of apertures 204 through the metallic material 102 proximate to the edge 108. The plastic material 110 envelops the edge 108 and the plurality of apertures 204. Moreover, the plastic material 110 extends through apertures 204, and thus the plastic material 110 not only adheres to the metallic material 102, but also extends through the apertures to contact itself. The plastic material 110 defines a distal edge 206 that runs substantially parallel to the edge 108. The plastic material 110 further defines a proximal edge 208 that is parallel to the edge 108 and is proximate the apertures 204. For structural integrity, the proximal edge 208 should be as close to the apertures 204 as possible without inadvertently exposing one or more apertures 204.

The metallic material 102 has a thickness T1, and the thickness of the metallic plate 102 decreases with continued use. In particular, when the metallic plate 102 is titanium, with use the surface becomes coated with a parasitic coating (e.g., antimony bismuth). When the parasitic coating is periodically removed (e.g., by grinding or brushing), a portion of the titanium is also removed. Thus, with time the thickness T1 of the metallic material 102 tends to decrease. In some embodiments, the thickness T1 when the metallic material is new is about 0.125 inch. The plastic material has a thickness T2, measured normal to the plane defined by the metallic material 102. In some embodiments, the thickness T2 is about 0.5 inch.

Figure 3:
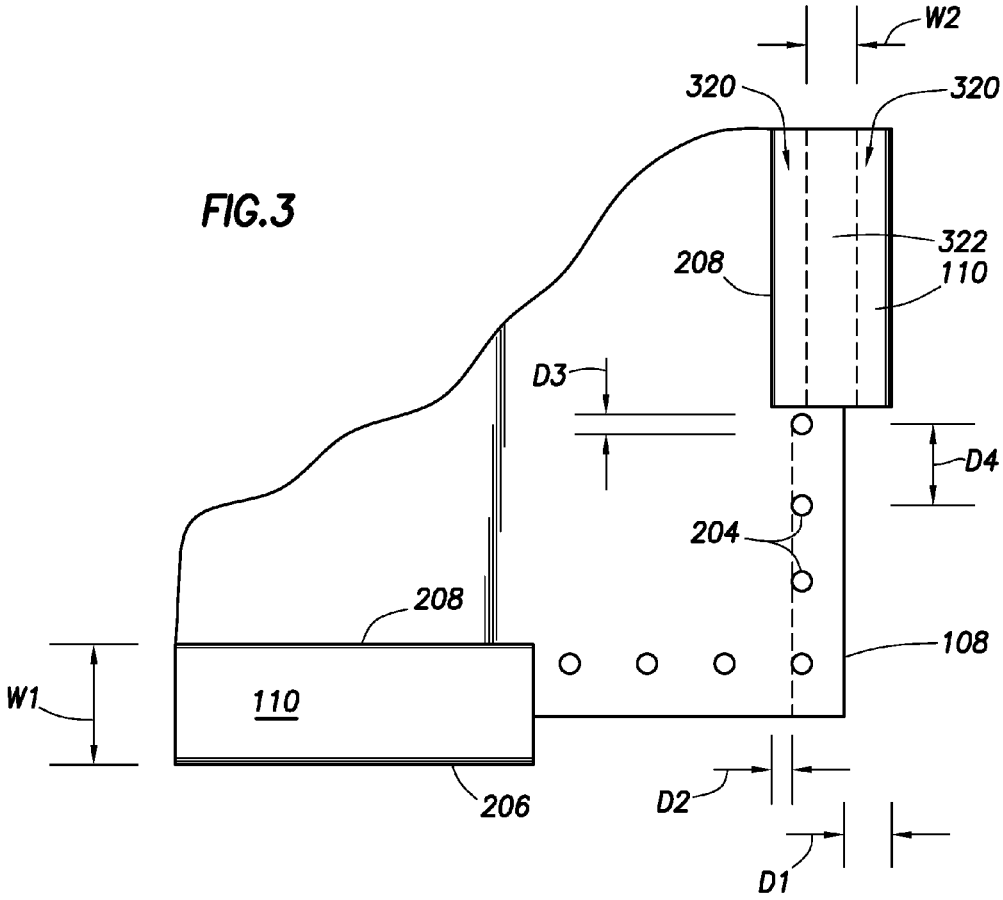
FIG. 3 shows an elevation view of the corner of the cathode of FIG. 2.

FIG. 3 shows an overhead view of the portion of the metallic material 102 and plastic material 110 of FIG. 2 to further illustrate relationships of the various components in accordance with at least some embodiments. In particular, FIG. 3 illustrates that the plastic material 110 has a width W1, measured from the distal edge 206 to the proximal edge 208. In some embodiments, the width W1 is about 0.875 inch. The plastic material 110 extends a distance D1 beyond the edge 108, and the distance D1 in some embodiments is about 0.25 inch. Further, the proximal edge 308 is within a distance D2 of the apertures 204, and the distance D2 is in some embodiments about 0.03125 inch. The apertures 304 have internal diameters D3, and in some embodiments the diameters D3 are about 0.25 inch. The apertures 304 have a center-to-center spacing D4, and in some embodiments the center-to-center spacing is on the order of 0.5 inch. As illustrated, in some embodiments the plastic material 110 has rounded corners 320, and flat portions 322 on the top and bottom, where the flat portions 322 define a plane that is substantially parallel to the plane defined by the metallic material 102. The flat portions 322 have a width W2, and in some embodiments the width W2 is between and including about 0.4375 to about 0.5625 inch. The specific relationship of the various components in FIGS. 2 and 3 is merely illustrative, and other thicknesses, distances, and spacings may be equivalently used.

In accordance with at least some embodiments, the plastic material 110 is polyurea. Polyurea is a polymer that has at least some elasticity (i.e., an elastomer or an elastomeric material). Polyurea is created by the mixing of an isocynate and a resin. While most commercially available polyurea has a chemical reaction or cure time of about 20 seconds (e.g., spray-on truck bed liners), for reasons that will become more clear based on the discussion below, the polyurea in accordance with at least some embodiments has a cure time of greater than 100 seconds, and in some cases a cure time of about 120 seconds. Polyurea with a cure time of greater than 100 seconds may be obtained from a variety of sources, such as The Sherwin-Williams Company of Cleveland, Ohio. Having a cathode 100 with a plastic material 110 being polyurea, the plastic material 110 has a significantly greater life span than the tape and "C" shaped plastic clips of the related art. For the various dimensions and relationships discussed to this point, the life span for the plastic material 110 in the form of polyurea is in most cases at least six months of near continuous use, and in many cases one year or more, before the plastic material 110 is removed and replaced.

While polyurea is an operable plastic material 110, other plastic materials may be used. Alternative plastic material 110 can be selected in view of the following criteria. The plastic material should have sufficient elasticity to withstand expected bending and/or flexing of the metallic material 102 during handling of the cathodes without severe cracking or severe loss of adherence to the underlying metallic material 102. More elasticity is needed for larger and/or thinner plates of metallic material 102, and less elasticity is needed for smaller and/or thicker plates of metallic material 102. The plastic material should have low reactivity with the solution used in the processor (e.g., a 10% sulfuric acid solution). The plastic material should have good resiliency to thermal shock. For example, the sulfuric acid solution may have a temperature of 170 degrees Fahrenheit in some electroplating operations, and thus thermal shocks between 170 degrees and room temperature can be expected. Finally, the plastic material itself, or an additive, should adhere to the metallic material 102 to reduce the occurrence of the sulfuric acid solution reaching the portion of the metallic material 102 enveloped by the plastic material.

An example of an alternate plastic material is polyurethane. Polyurethane differs from polyurea at least in that a catalyst is used to facilitate the chemical reaction of the components. Further still, epoxy compounds with sufficient elasticity may be equivalently used. Yet further still, polyethylene, polypropylene and/or polystyrene, in formulations that meet the criteria above, may be equivalently used.

Figure 4:
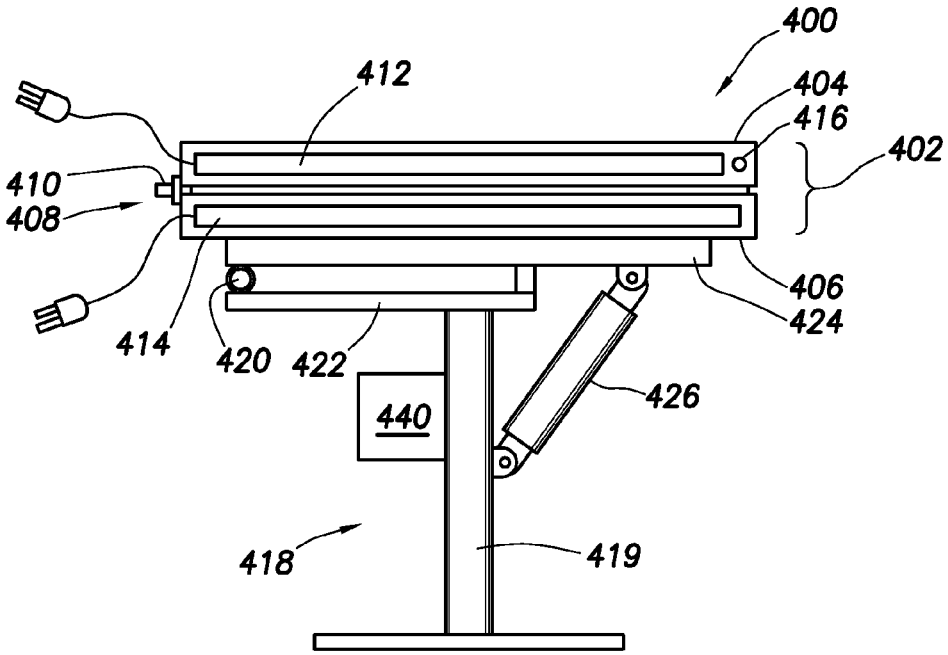
FIG. 4 shows a side elevation view of a mold system in accordance with at least some embodiments.

The specification now turns to forming the plastic material 110 on the metallic material 102. In particular, in accordance with at least some embodiments, the plastic material 110 is formed by an injection molding process. FIG. 4 shows a side elevation view of a of mold system 400 in accordance with at least some embodiments. In particular, the mold system 400 comprises a mold 402 that has a top half 404 and a bottom half 406. The top half 404 is configured to selectively couple to and retract from the bottom half 406. When retracted, the metallic material 102 of a cathode 100 (not shown in FIG. 4) may be inserted between, or removed from, the mold halves 404 and 406. When coupled, the top half 404 and bottom half 406 define an internal volume whose cross-sectional shape (not shown in FIG. 4) is that of the plastic material 110. During formation of the plastic material 110, the plastic material is injected into the internal volume by way of an injection point 408. In order to prevent backflow of the plastic material in its liquid state, a check valve 410 may be used. The plastic material 110 may harden within the check valve 410 during curing, and thus the check valves may be single use, disposable items.

In some embodiments, during injection and curing the mold 402 is held at an elevated temperature above room temperature. To this end, in some embodiments the top half 404 comprises a heating element 412, and the bottom half 406 comprises a heating element 414. In some embodiments the heating elements are 220V AC heat strips using a thermostat to control the temperature. However, other heating elements (e.g., tubing through which heated fluid is pumped) may be equivalently used. In the case of the plastic material being a polyurea with a cure time of about 120 seconds, the mold area may be heated to between and including 170 to 178 degrees Fahrenheit. Differing cure times for the polyurea, and likewise differing plastic materials, may utilize different mold 402 temperatures.

As the liquid plastic material is injected through the injection point 408 by way of the check valve 410, displaced air within the internal volume of the mold 402 escapes through the vent port 416. Though the vent port 416 is shown in the top half 404, the vent port may be equivalently located in the bottom half 406, particularly since the mold 402 is, in some embodiments, elevated during injection (discussed more below). Once the liquid plastic material displaces the air within the internal volume, the vent port 416 may be sealed by any suitable mechanism. While only one vent port 416 is illustrated, multiple vent ports may be used, such as one vent port at each upper-most elevation of the mold 402 if the mold comprises multiple branches.

Still referring to FIG. 4, the mold system 400 further comprises a frame 418. The illustrative frame 418 has single center leg 419, upon which the various other frame members and components are coupled. In alternative embodiments, the frame member 418 may comprise a plurality of legs (e.g., three or four). The frame 418 comprises a hinge 420 that couples to the lower half 406 of the mold 402. The hinge 420 enables rotation of the mold 402 about an axis through the hinge (in the view of FIG. 4 the axis extends out of the page). In the embodiments of FIG. 4, the hinge couples between a first frame member 422, and a second frame member 424, with the second frame member 424 coupled to the lower half 406 of mold 402. The frame member 424 between the hinge and mold may be used in embodiments where the structural strength of the mold is low, such as if the mold 402 is made of plastic. However, in other embodiments the mold may be made of steel, and thus may have sufficient structural strength to couple directly to the hinge 420.

In order to rotate the mold 402 about the hinge 420, an actuator 426 couples from a stationary portion of the frame 418 (as illustrated the center leg 419) to the mold 402. The actuator 426 may be any suitable linear actuator, such as a hydraulic cylinder, pneumatic cylinder, or electric linear actuator. In the embodiments illustrated, in a retracted orientation of the actuator 426 the mold 402 is horizontal, and in an extended orientation of the actuator 426, the mold 402 is rotated about hinge 420 such that the vent port 416 is above the injection point 408. In some cases the mold system 400 comprises a vibrator assembly 440 coupled to the frame 418. The vibrator assembly 440 is any assembly that produces or induces vibratory motion to frame 418, and thus in the mold 402, during injection. In some embodiments the vibrator assembly 440 is an electric motor with an eccentric weight, but other mechanisms may be equivalently used.

Figure 5:
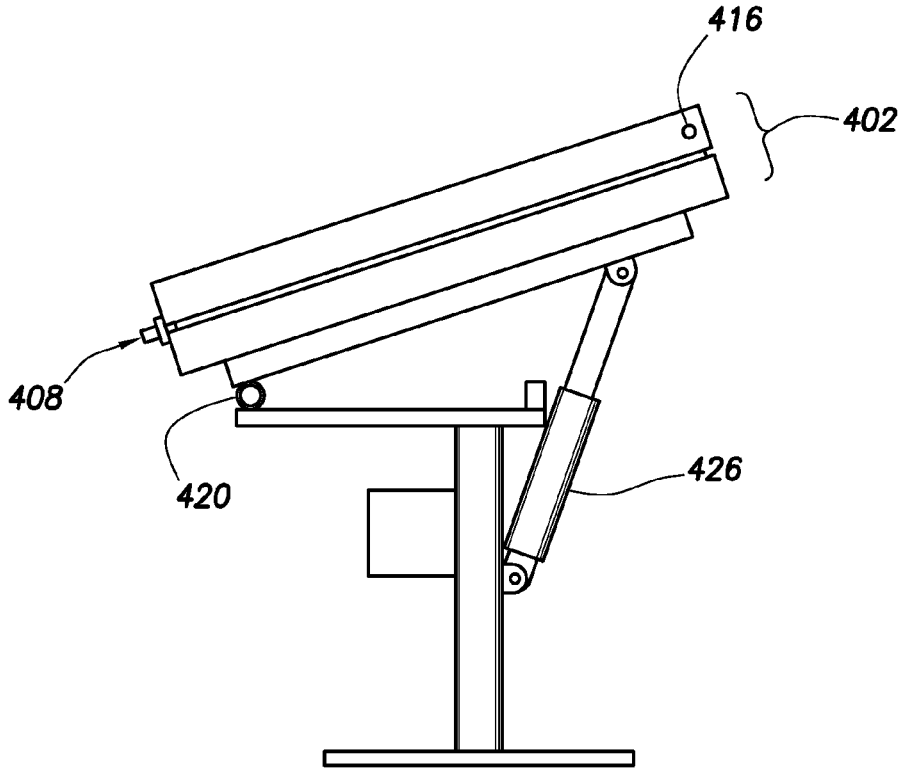
FIG. 5 shows a side elevation view of the mold system with the mold raised, in accordance with at least some embodiments.

FIG. 5 shows a side elevation view with the mold system 400 of FIG. 4 with the mold 402 rotated about hinge 420. In particular, with the actuator 426 in its extended orientation, the mold 402 rotates about hinge 420. In the process, the vent port 416 is elevated above the injection point 408. Such an orientation, along with other measures discussed below, helps ensure that during injection of the liquid plastic material, air within internal volume of the mold 402 stays above the liquid plastic material. In some embodiments, the mold system 400 is configured to rotate the mold 402 to an angle of about 45 degrees as measured from horizontal, but in other embodiments greater or lesser angles may be equivalently used.

Figure 6:
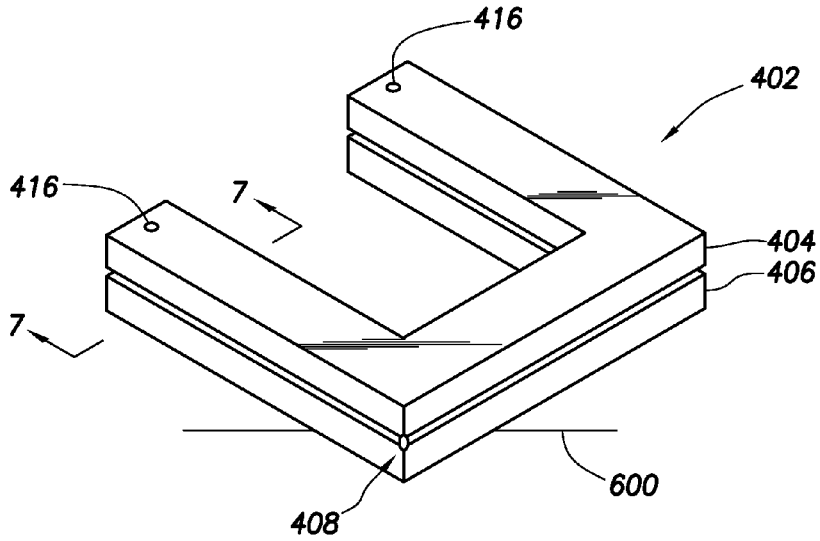
FIG. 6 shows a perspective view of the mold in accordance with at least some embodiments.

FIG. 6 shows a perspective view of the mold 402 in accordance with embodiments where the plastic material 110 (not shown in FIG. 6) couples to three sides of the metallic material 102 (also not shown in FIG. 6). In particular, FIG. 6 shows the upper half 404 and the lower half 406 of the mold 402. Because the illustrative mold 402 is configured to create plastic material on three sides of the metallic material, the mold has a "U" shape. In embodiments where only two sides of the metallic material are to have the plastic material, the mold 402 may have an "L" shape or a "II" shape. FIG. 6 also illustrates the injection point 408, along with alternative locations for the vent ports 416. In the embodiments illustrated in FIG. 6, rotation of the mold 402 may be about axis 600, such that both vent ports 416 are above the injection point 408 during injection of the liquid plastic material.

Figure 7:
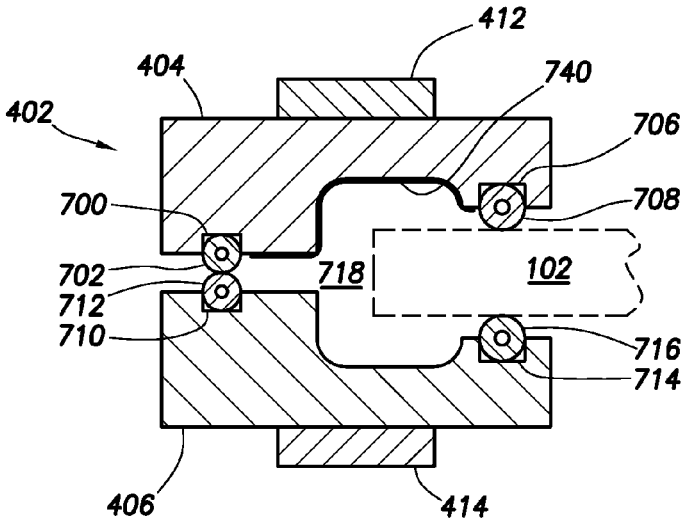
FIG. 7 shows a cross-section view of the mold in accordance with at least some embodiments.

FIG. 7 is a cross-section elevation view of the mold 402 taken substantially along line 7-7 of FIG. 6. In particular, FIG. 7 shows the mold 402 with upper half 404 coupled to the lower half 406. The upper half 404 of mold 402 has an outer groove 700 within which a sealing element 702 is placed. While in some cases the sealing element may be a rubber o-ring, in other cases sufficient sealing is achieved by use of plastic tubing (as illustrated). The upper half 404 of the mold 402 further comprises an inner groove 706 that likewise has a sealing element 708 that, in some embodiments, is plastic tubing. The lower half 406 of mold 402 has an outer groove 710 within which a sealing element 712 is placed. The lower half 406 of the mold 402 also has an inner groove 714 that likewise has a sealing element 716. By way of the upper half 404 and lower half 406, the mold 402 defines an internal volume 718. In some cases, at least a portion of the internal volume may have coating 740 (illustrated only on the upper half 404, but if used would likewise be present on the lower half 406) that reduces sticking of the plastic material to the mold during injection and curing (e.g., a coating of tetrafluoroethylene, commonly known as TEFFLON®). FIG. 7 further illustrates alternative placement of the heating elements 412 and 414.

The sealing elements 702 and 712, in their respective outer grooves 700 and 710, physically touch and thus seal to each other. The sealing elements 708 and 716, in their respective inner grooves 706 and 714, physically touch and thus seal to the metallic material 102 (shown in dashed lines). The "seal" provided by the sealing elements at some portions of the injection process need not provide a 100% seal, and in fact in some cases the seal provided is less than a complete seal. That is, during a particular portion of the injection process, the seal allows air within the inner volume 718 to escape, and in some cases some of the liquid plastic material may also escape.

The specification to this point illustrates the cathode 100 along with the plastic material 110 that adheres to the cathode and thus reduces or eliminates electroplating of copper in the locations where the plastic material is present. Further, the specification to this point illustrates a mold system 400 used to form the plastic material. In the process, particular elements of a method to form the plastic material 110 around the metallic material 102 have been discussed. Now, however, the specification turns to an illustrative step-by-step method for forming the plastic material 110 to envelop and adhere to the edge 108 of the metallic material 102. The various steps discussed below are merely illustrative. The order of the steps may be changed, and in some cases one or more steps omitted, and the yet the advantages of the various embodiments may still be achieved.

Figure 8B:
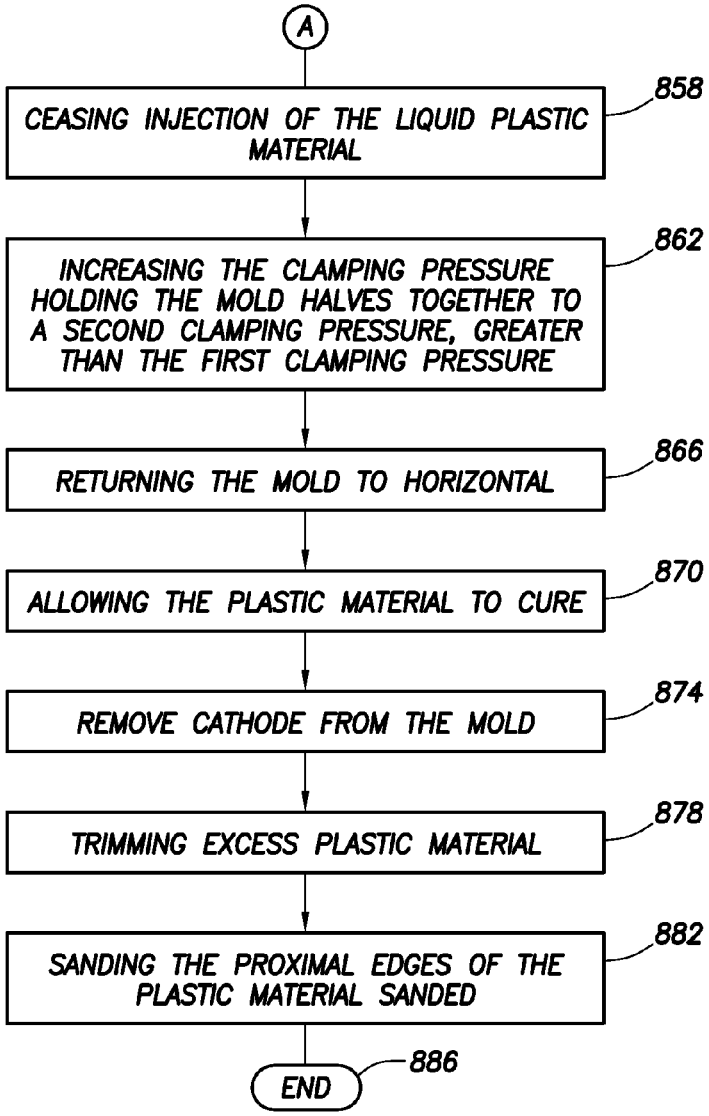
FIG. 8B shows a portion of a method in accordance with at least some embodiments.
Figure 8A:
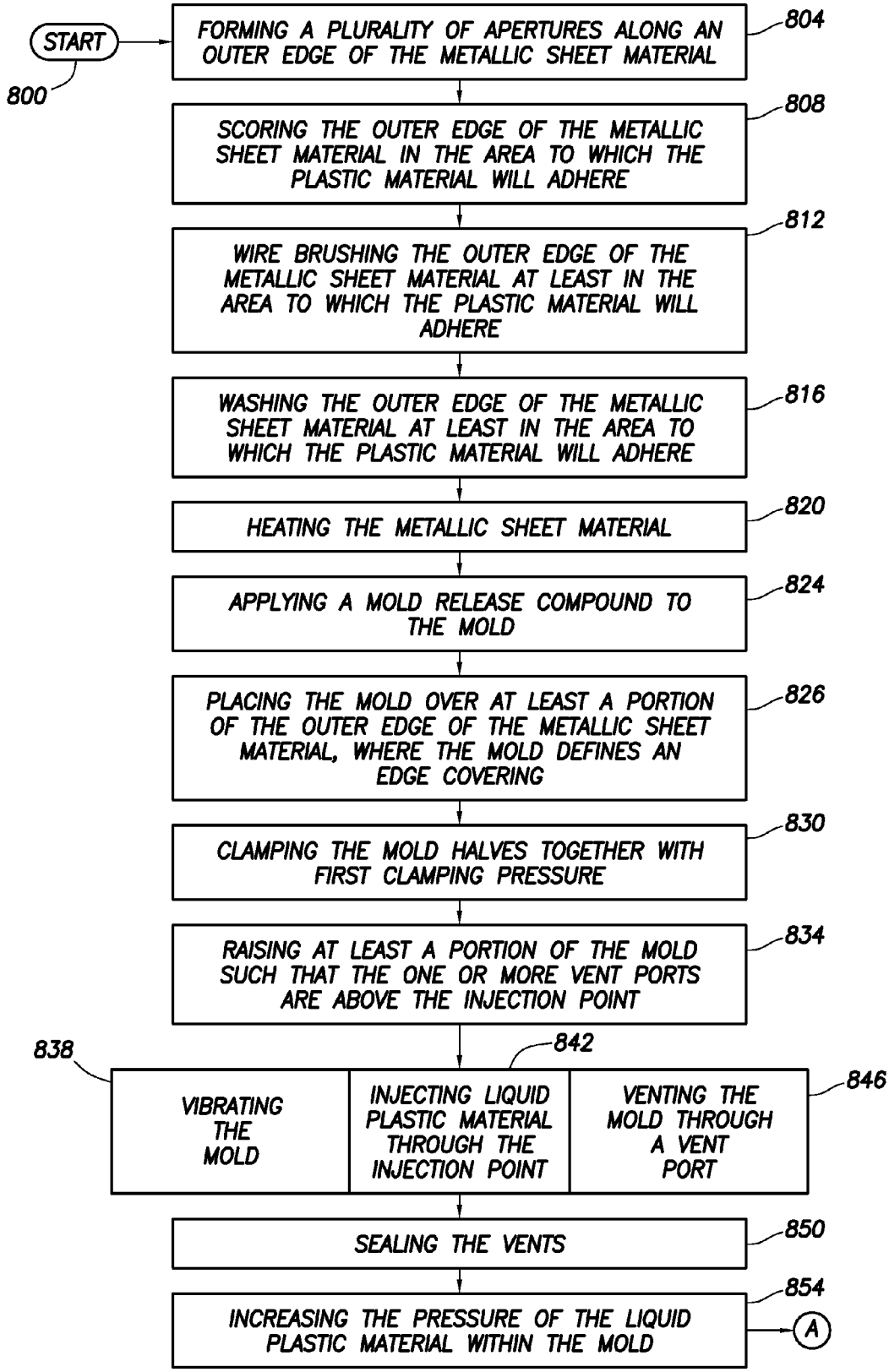
FIG. 8A shows a portion of a method in accordance with at least some embodiments.

FIG. 8 (comprising FIGS. 8A and 8B) shows a method in accordance with at least some embodiments. In particular, the method starts (block 800) and proceeds to forming a plurality of apertures along an outer edge of the metallic material (block 804). In some cases, the apertures are punched, but other methods of forming the apertures may be equivalently used. In some embodiments, the apertures have about 0.25 inch inside diameters, and are on about 0.5 inch centers, but other sizes and center-to-center spacing may be equivalently used. If the metallic material already has the apertures (e.g., from a previous preparation), forming the apertures may be omitted.

Next, the illustrative method advances to scoring the outer edge of the metallic sheet material in the area to which the plastic material will adhere (block 808). In accordance with at least some embodiments, and where the metallic material is titanium, the scoring takes place by way of a stack of metal cutting wheels (e.g., four) coupled to a grinder. The metal cutting wheels may be, for example, Dewalt Type 1 cutting wheels available from DeWALT Industrial Tool Co. of Baltimore, Md. The force with which the cutting wheels are pressed against the metallic material is not sufficient to cut the metallic material, but only sufficient to lightly score the edge, with the score lines running roughly parallel to the edge 108. While the inventor has found that the stack of cutting wheels works well, other scoring systems (e.g., diamond coated grinding wheels), and other scoring directions (e.g., roughly perpendicular to the edge 108) may be equivalently used, with the precise selection based on the selected metallic material 102. Although the inventor shall not be tied to any particular interpretation of the reasons for scoring, it is believed that scoring to some extent cleans the area to which the plastic material will adhere, and may also increase the surface area for adhesion.

Next, the illustrative method moves to wire brushing the outer edge of the metallic sheet material at least in the area to which the plastic material will adhere (block 812). In some embodiments, the wire brushing takes place by way of a wire brush coupled to a grinder, but other wire brushing mechanisms may be equivalently used. Although the inventor shall not be tied to any particular interpretation of the reasons for wire brushing, it is believed that wire brushing to some extent cleans the area to which the plastic material will adhere, and may also increase the surface area for adhesion.

Next, the illustrative method moves to washing the outer edge of the metallic sheet material at least in the area to which the plastic material will adhere (block 816). In some embodiments, the washing is by way of an acetone soaked rag or towel. Although the inventor shall not be tied to any particular interpretation of the reasons for washing, it is believed that washing to some extent cleans the area to which the plastic material will adhere, and may also remove chemical residues.

Next, the illustrative method moves to heating the metallic sheet material (block 820). In some embodiments, and based on injecting polyurea with a 120 second cure time, the heating is to a temperature of between and including 85 to 95 degrees Fahrenheit. Other temperatures may be appropriate for different plastics, for example, faster curing polyurea may utilize lower pre-heat on the metallic material.

Next, the illustrative method proceeds to applying a mold release compound to the mold (block 824). Any of a variety of mold release compounds may be used, such as item number 738 from McLube, a division of McGee Industries, Inc. of Aston, Pa., or the Rocket Release product of Stoner, Inc. of Quarryville, Pa. In embodiments where the mold 402 has a coating 740 that reduces sticking of the plastic material to the mold during injection and curing, applying the mold release compound may be omitted.

Next, the mold is placed over at least a portion of the outer edge of the metallic sheet material, where the mold defines an edge covering (block 826). In some embodiments, the cathode 100 is placed between the halves of the mold 402 by hand; however, automated placement may be equivalently used. The halves of the mold 402 are held together with first clamping pressure (block 830). Thereafter, at least a portion of the mold 402 raised such that the one or more vent ports 416 are above the injection point 408 (block 834). With the mold 402 raised, simultaneously the mold is vibrated (block 838), the liquid plastic material is injected through the injection point (block 842), and the mold is vented through the one or more vent ports (block 846).

The inventor of the present specification has found that elevating the mold 402 such that the one or more vent ports 416 are above the injection point 408 reduces the occurrence of air bubbles being trapped at the interface of the plastic material 110 and the metallic material 102. Air bubbles trapped at the interface reduce adhesion surface area and reduce the useful life span. Although the inventor shall not be tied to any particular interpretation of the reasons for elevating, it is believed that elevating the vent ports above the injection port keeps the air above the liquid plastic material, reducing the likelihood of trapping air bubbles. In accordance with embodiments using a polyurea with about 120 second cure time, during the time when venting of the mold 402 is taking place, the polyurea is injected at a pressure of about 300 pounds per square inch gauge (PSIG), and at a temperature of about 130 degrees F. For a particular size of cathode 100, a cure time of 120 seconds allows sufficient time for the polyurea in liquid form to fill mold, and sealing the vents, before significant curing takes place. For smaller molds, or perhaps higher mold temperatures, shorting cure times may be used.

Further, the inventor of the present specification has found that vibrating the mold 402 during a portion of the injecting reduces the occurrence of air bubbles trapped at the interface of the plastic material 110 and the metallic material 102. Although the inventor shall not be tied to any particular interpretation of the reasons vibrating reduces occurrence of trapped air bubbles, it is believed that the vibration assists the movement of the plastic material along the mold. The frequency and amplitude of the vibrations are, in some cases, high and low, respectively. Lower frequencies, and particularly high amplitudes, may cause sloshing of the liquid plastic material, increasing the likelihood of trapping air bubbles.

Once the air within the internal volume has been displaced by the liquid plastic material, as shown by liquid plastic material escaping the vent ports 416, the vents are sealed (block 850). The pressure of the liquid plastic material within the mold is then increased to about 700 PSIG (block 854), and then injection of the liquid plastic material ceases (block 858). In some cases, the continued pumping of the liquid plastic material against the sealed volume of the mold is sufficient to increase the pressure, but in other embodiments increased pump speed or pump stroke may be utilized to achieve the increased pressure. As alluded to above, the seal provided between the mold 402 halves may be less than a 100% seal. Air within the mold 402 may escape through the seal during the injection process, particularly after the pressure of the liquid plastic material within the mold 402 is increased after sealing the vent ports 415. After sealing of the mold and increasing the pressure of the liquid plastic material, the clamping pressure holding the mold halves together is increased (block 862), thus bring the mold 402 halves closer together. Although the inventor shall not be tied to any particular interpretation of the reasons for increasing the clamping pressure, it is believed that increasing the clamping pressure further increases the pressure of the liquid material in the mold thus helping force air bubbles out the seals.

Next, the mold 402 is returned to horizontal (block 866), and the plastic material is allowed to cure for at least the cure time of the plastic material (e.g., 120 seconds) (block 870). Thereafter, the cathode is removed from the mold (block 874), and the excess plastic material is trimmed from both the distal edge 206 and proximal edges (block 878), such as by using a box cutter or similar cutting system. Finally, each proximal edge 208 is sanded (block 882), and the method ends (block 886). The sanding helps ensure a substantially smooth transition between the plastic material 100 and metallic material 102 at the proximal edges 208 (both sides).

Figure 9:
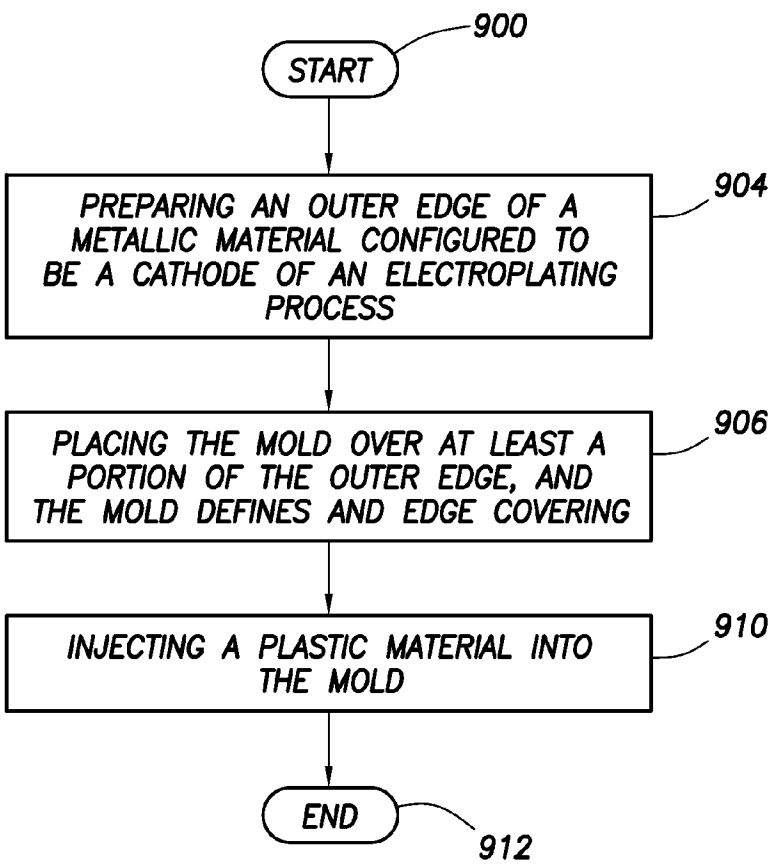
FIG. 9 shows a method in accordance with at least some embodiments.

Having now detailed the various steps to form the plastic material 110 enveloping the edge 108 of the metallic material, the specification now turns to a high level abstraction of the method as illustrated in FIG. 9. In particular, the method starts (block 900) and proceeds to preparing an outer edge of a metallic material configured to be a cathode of an electroplating process (block 904). Next, a mold is placed over at least a portion of the outer edge, and the mold defines an edge covering (block 906). After placing the mold, the illustrative method advances to injecting a plastic material into the mold (block 910), and the illustrative method ends (block 912).

Figure 10:
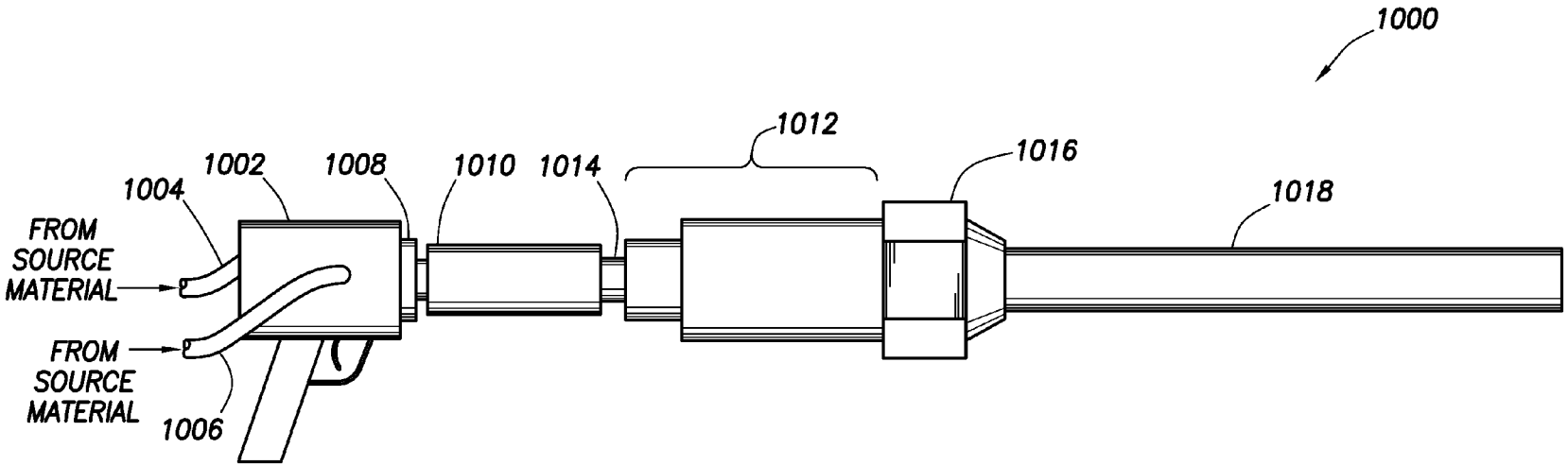
FIG. 10 shows an elevation view of an injection system in accordance with at least some embodiments.

The discussion now turns to mixing of the liquid components of the plastic material just prior to injection into the mold. In particular, FIG. 10 shows a side elevation view of the injection system 1000 in accordance with at least some embodiments. The injection system 1000 comprises a mixing gun 1002 configured to couple to the uncombined components of the plastic material by way of hoses 1004 and 1006. In accordance with at least some embodiments, the mixing gun 1002 is an impingement-type mixing gun, such as air purge plural component guns available from Graco, Inc. of Minneapolis, Minn. The mixing gun 1002 has a tip 1008 that fluidly couples to the portion of the gun where impingement mixing takes place. The tip 1008 has a passage with that feeds into, in the illustrative embodiments, a plastic tube 1010. The plastic tube 1010 couples to the tip 1008 by way of an outside diameter of the tip 1008. The inside diameter of the plastic tube is greater than the inside diameter of the tip 1008 and thus the plastic tube 1010 forms a first chamber.

The plastic tube 1010 in turn couples, in at least some embodiments, to a metallic member 1012. The plastic member 1010 couples to the metallic member 1012 by coupling to an outside diameter of nipple 1014 of the metallic member 1012. The nipple 1014 has a passage fluidly coupled to a chamber formed by the metallic member 1012, and the internal diameter of the chamber of metallic member 1012 is greater than the internal diameter of the passage of the nipple 1014. The metallic member 1012 comprises a second nipple (not visible in FIG. 10 because of the compression nut 1016) with a passage that has an internal diameter less than the chamber of the metallic member 1012. Coupled to the second nipple of the metallic member 1012 is a mixing tube 1018. Mixing tube 1018 has an internal diameter greater than the internal diameter of the passage of the nipple under the compression nut 1016. Moreover, in accordance with at least some embodiments, the mixing tube 1018 has a plurality of static inner components that facilitate agitation of the liquid plastic material. The mixing tube 1018 may be, for example, a high pressure static element mixing tube available from Lpscott, Inc. of St. Wylie, Tex.

Figure 11:
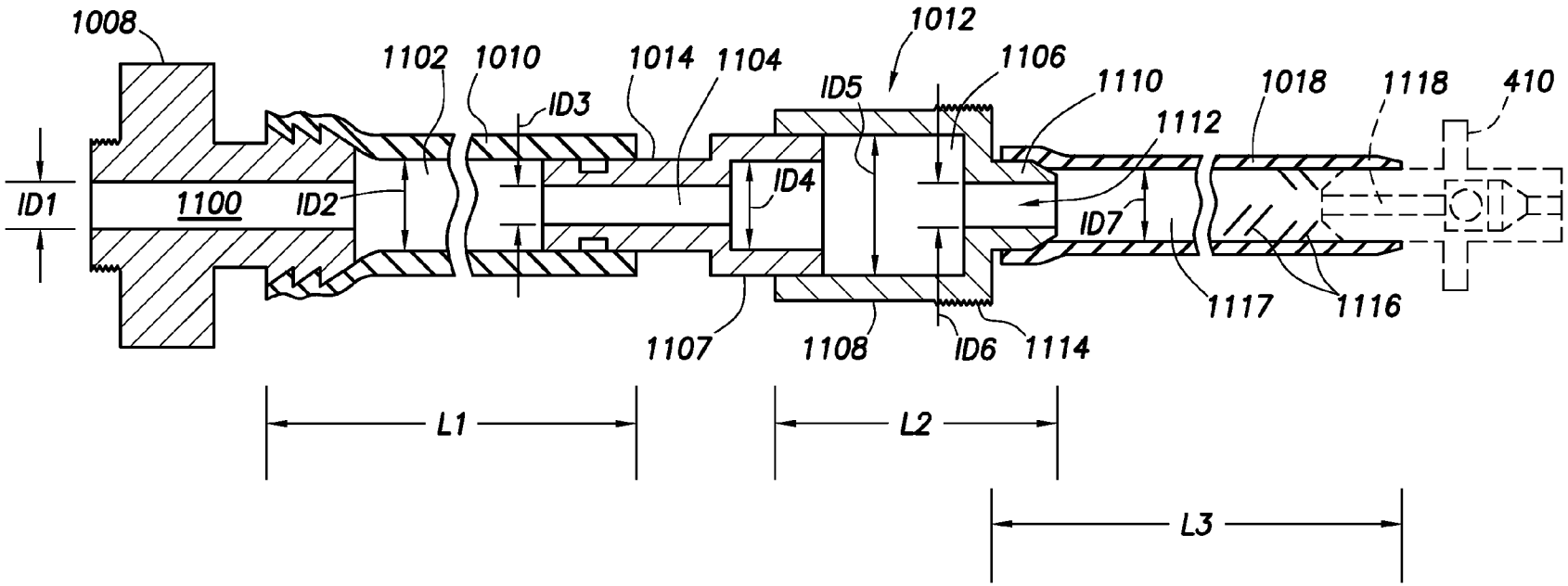
FIG. 11 shows a cross-section of a portion of the injection system.

FIG. 11 shows a cross-section of the system of FIG. 10 starting with the tip 1008. In particular, the tip 1008 has an aperture 1100 with an internal diameter ID1. In accordance with at least some embodiments, the internal diameter ID1 is 0.125 inch. The passage 1100 of the tip 1008 fluidly couples to a chamber 1102 formed by the plastic tube 1010. The chamber 1102 has an internal diameter ID2, and the plastic tube has a length L1. In accordance with at least some embodiments, the internal diameter ID2 is about 0.25 inch, a length L1 is about 3 inches, and the tube has a 0.375 inch outside diameter. However, the plastic tube 1010 couples to an outside diameter of the tip 1008 (e.g., hose barbs) and an outside diameter of the nipple 1014, and thus the chamber 1102 does not span the entire length L1.

The chamber 1102 fluidly couples to a passage 1104 in the tip 1014 of the metallic member 1012. The passage 1104 of tip 1014 has an internal diameter ID3, and in some embodiments the internal diameter ID3 is about 0.125 inch. The passage 1104 is fluidly coupled to a chamber 1106 formed by metallic member 1012. In accordance with at least some embodiments, the tip 1014, the passage 1104, and a portion of the chamber 1106 are formed by a male quick connect fitting 1107 threadingly coupled to an inside diameter of a second piece 1108. Thus, the chamber 1106 in accordance with some embodiments comprises two different internal diameters, ID4 and ID5, and the second piece 1108 has a length L2 measured to the distal end of tip 1110. In accordance with at least some embodiments the internal diameter ID4 is about 0.25 inch, the internal diameter ID5 is about 0.5 inch, and the length L2 is about 2 inches. The tip 1110 defines a passage 1112 having an internal diameter ID6. In accordance with at least some embodiments the internal diameter ID6 is about 0.1875 inch.

Still referring to FIG. 11, the mixing tube 1018 couples to an outside diameter of the tip 1110. A compression nut 1016 (not shown in FIG. 11) may couple to threads 1114 on an outside diameter of the metallic member 1012 to assist in keeping the mixing tube 1018 coupled to the tip 1110. The mixing tube has a plurality of static members 1116 in the chamber 1117 which assist in mixing of the components of the liquid plastic material. The mixing tube 1018 has an internal diameter ID7 and a length L3. In some embodiments the internal diameter ID7 is about 0.25 inch, the length L3 is about 8 inches, and the mixing tube has a 0.375 inch outside diameter. In use, the static mixing tube couples to the check valve 410 (FIG. 4, shown here in dashed lines), and thus the liquid plastic material enters the mold 402 through the check valve 410. However, the check valve has a passage 1118 whose internal diameter is smaller than the internal diameter of the mixing tube 1018.

Although the inventor shall not be tied to any particular interpretation of the reasons for having multiple chambers connected by passages with smaller internal diameters than the chambers, it is believed that having the liquid plastic material traverse the relatively larger chambers and the passages with smaller diameter facilitates better mixing of the components of the plastic material (which components may have different viscosities and different specific gravity). Moreover, the amount of time that the plastic material utilizes to traverse the various chambers of the system of FIG. 10 may enable an at least partial cure of the plastic material, which partial cure may increase viscosity of the liquid plastic material prior to injection through the check valve 410, and which may reduce the tendency of the components to separate during injection and/or within the mold.

Figure 12:
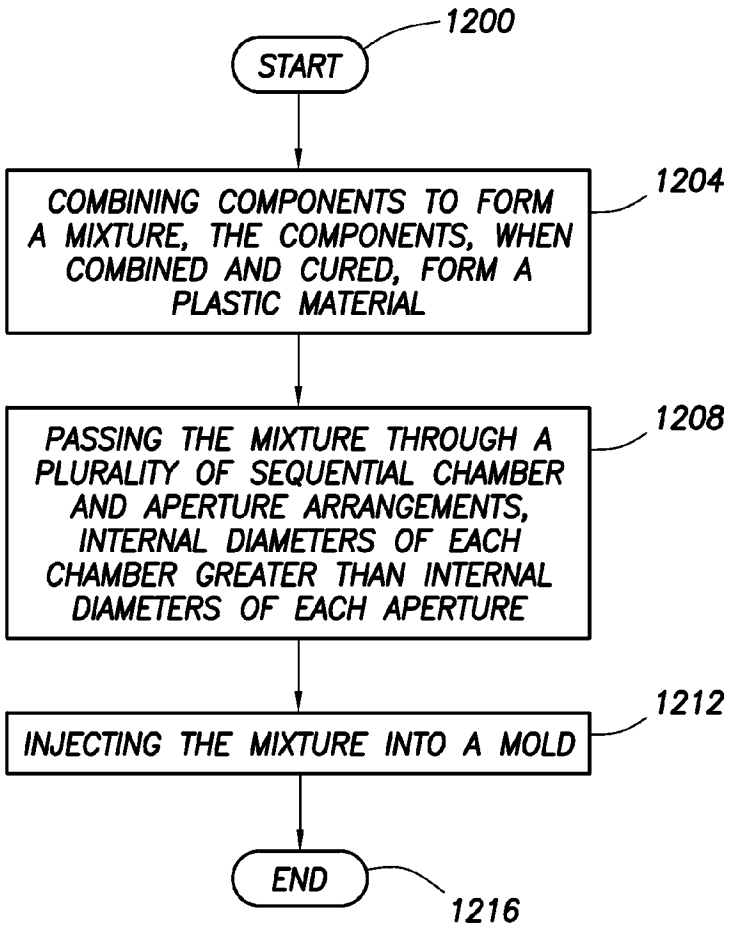
FIG. 12 shows a method in accordance with at least some embodiments.

FIG. 12 illustrates a method in accordance with at least some embodiments. In particular, the method starts (block 1200) and proceeds to combining components to form a mixture, the components, when combined and cured, form a plastic material (block 1204). Next, the method proceeds to passing the mixture through a plurality of sequential chamber and aperture arrangements (e.g., the apertures forming the entrance to the passages), internal diameters of each chamber greater than internal diameters of each aperture (block 1208). Then, injecting the mixture into a mold (block 1212) and the method ends (block 1216).

The above discussion is meant to be illustrative of the principles and various embodiments of the present invention. Numerous variations and modifications will become apparent to those skilled in the art once the above disclosure is fully appreciated. It is intended that the following claims be interpreted to embrace all such variations and modifications.

What is claimed is:

1. A method comprising:

combining components to form a mixture, the components, when combined and cured, form a plastic material;

passing the mixture through a first chamber fluidly coupled to a nozzle of a mixing gun, the nozzle defining a first passage, and the first chamber having an internal diameter greater than the first passage;

passing the mixture through a second chamber fluidly coupled to the first chamber by a second passage, the second chamber having an internal diameter greater than the first passage and greater than the second passage and greater than the first chamber;

passing the mixture through a third chamber fluidly coupled to the second chamber by a third passage, the third chamber configured to couple to an injection point of a mold, and the third chamber having an internal diameter greater than the third passage; and then injecting the mixture into a mold.

2. The method of claim 1 wherein combining further comprises combining by a mixing gun where the components are at least partially mixed by impingement of the components.

3. The method of claim 1 wherein passing the mixture through the first chamber further comprises passing the mixture through the first chamber having an internal diameter of about 0.25 inch and the first aperture having a diameter of about 0.125 inch.

4. The method of claim 1 wherein passing the mixture through the second chamber further comprises passing the mixture through the second chamber having an internal diameter of about 0.50 inch and the second aperture having a diameter of about 0.125 inch.

5. The method of claim 4 wherein passing the mixture through the second chamber further comprises passing the mixture through the second chamber having a first internal diameter of about 0.25 inch and a second internal diameter of about 0.50 inch.

6. The method of claim 1 wherein passing the mixture through the third chamber further comprises passing the mixture through the third chamber having a plurality of mixing elements.

7. The method of claim 1 wherein passing the mixture through the third chamber further comprises passing the mixture through the third chamber having an internal diameter of about 0.25 inch and the third aperture having a diameter of about 0.1875 inch.

8. The method of claim 7 wherein the third chamber has a plurality of mixing elements on the inside diameter.

9. The method of claim 1 wherein the mixture is allowed to partially cure before being injected into the mold.

10. A method comprising:

combining components to form a mixture, the components, when combined and cured, form a plastic material;

passing the mixture through a first chamber fluidly coupled to a nozzle of a mixing gun, the nozzle defining a first passage, and the first chamber having an internal diameter greater than the first passage;

passing the mixture through a second chamber fluidly coupled to the first chamber by a second passage, the second chamber having an internal diameter greater than the first passage and greater than the second passage and greater than the first chamber;

passing the mixture through a third chamber fluidly coupled to the second chamber by a third passage, the third chamber having a multitude of static mixing elements and having an internal diameter greater than the third passage;

passing the mixture through a check valve, the check valve comprising a passage having an internal diameter smaller than the internal diameter of the third chamber; and then injecting the mixture into a mold.

11. A system comprising:

a first chamber configured to be fluidly coupled to a nozzle of a mixing gun, the nozzle defines a first passage, and the first chamber having an internal diameter greater than the first passage;

a second chamber fluidly coupled to the first chamber by a second passage, the second chamber having an internal diameter greater than the first passage, greater than the second passage, and greater than the first chamber; and a third chamber fluidly coupled to the second chamber by a third passage, the third chamber configured to couple to an injection point of a mold, and the third chamber having an internal diameter greater than the third passage.

12. The system of claim 11 further comprising a mixing gun configured to couple to uncombined components of polyurea, the mixing gun configured to create a mixture of the uncombined components and pass the mixture through the first passage.

13. The system of claim 11 wherein the third chamber further comprises a plurality of components on the internal diameter configured to at least partially mix the components of the mixture.

14. The system of claim 13 wherein the third chamber has a length of about eight inches or less.

15. The system of claim 11 wherein the first chamber further comprises plastic tubing that has an internal diameter of about 0.25 inch, and the first passage has an internal diameter of about 0.125 inch.

16. The system of claim 15 wherein the plastic tubing has a length of about three inches.

17. The system of claim 11 wherein the second chamber further comprises a metallic member that has an internal diameter of about 0.5 inch, and the second passage has an internal diameter of about 0.125 inch.

18. The system of claim 17 wherein the second chamber also has an internal diameter of about 0.25 inch.

19. The system of claim 11 wherein the third chamber is configured to be fluidly coupled to a check valve.

20. The system of claim 19 wherein the check valve comprises a passage having an internal diameter smaller than the internal diameter of the third chamber.

* * * * *